US012296217B2

(12) United States Patent
Meredith

(10) Patent No.: US 12,296,217 B2
(45) Date of Patent: May 13, 2025

(54) DUAL ACTION WEIGHTLIFTING MACHINE WITH SELECTORIZED RESISTANCE

(71) Applicant: HOIST FITNESS SYSTEMS, INC., Poway, CA (US)

(72) Inventor: Jeffrey O. Meredith, Del Mar, CA (US)

(73) Assignee: HOIST FITNESS SYSTEMS, INC., Poway, CA (US)

( * ) Notice: Subject to any disclaimer, the term of this patent is extended or adjusted under 35 U.S.C. 154(b) by 194 days.

(21) Appl. No.: 18/226,964

(22) Filed: Jul. 27, 2023

(65) Prior Publication Data

US 2024/0042262 A1 Feb. 8, 2024

Related U.S. Application Data

(60) Provisional application No. 63/395,112, filed on Aug. 4, 2022.

(51) Int. Cl.
*A63B 21/062* (2006.01)
*A63B 21/00* (2006.01)
(Continued)

(52) U.S. Cl.
CPC ..... *A63B 21/0628* (2015.10); *A63B 21/156* (2013.01); *A63B 21/4035* (2015.10);
(Continued)

(58) Field of Classification Search
CPC ..... A63B 21/00058; A63B 21/00065; A63B 21/00069; A63B 21/00076; A63B 21/062;
(Continued)

(56) References Cited

U.S. PATENT DOCUMENTS 5,184,992 A 2/1993 Banks
5,725,459 A * 3/1998 Rexach ..... A63B 23/03566 482/92
(Continued)

FOREIGN PATENT DOCUMENTS

CN 106110566 A * 11/2016
CN 217511067 U 9/2022
KR 101394856 B1 5/2014

OTHER PUBLICATIONS

United States International Searching Authority, International Search Report and Written Opinion for corresponding International Application No. PCT/US2023/028791, mailed Oct. 24, 2023, 8 pages.
(Continued)

*Primary Examiner* — Gary D Urbiel Goldner
(74) *Attorney, Agent, or Firm* — David R. Heckadon; Gordon Rees Scully Mansukhani LLP

(57) ABSTRACT

An exercise machine, having: (a) a frame; (b) a pair of weight stacks connected to opposite sides of the frame; (c) a pair of vertically moveable pulley carriages connected to front portions of the frame; (d) a lifting bar assembly connected to a rear portion of the frame; (e) a pair of arm cables, wherein each of the arm cables are connected to one of the pulley carriages and pass around a first series of pulleys such that the weight stacks are lifted when the arm cables are pulled by a user through the pulley carriages; and (f) a pair of lifting bar cables respectively connected to a pair of vertically moveable bar mounts of the lifting bar assembly that pass around a second series of pulleys such that the weight stacks are lifted when a lifting bar of the lifting bar assembly is raised by the user.

16 Claims, 19 Drawing Sheets

(51) Int. Cl.
*A63B 23/035* (2006.01)
*A63B 23/12* (2006.01)

(52) U.S. Cl.
CPC .... *A63B 21/4045* (2015.10); *A63B 23/03525* (2013.01); *A63B 23/1218* (2013.01)

(58) Field of Classification Search
CPC ..... A63B 21/0626; A63B 21/0628; A63B 21/0724; A63B 21/078; A63B 21/0783; A63B 21/15; A63B 21/151; A63B 21/152; A63B 21/154; A63B 21/156; A63B 21/4035; A63B 21/4045; A63B 23/035; A63B 23/03508; A63B 23/03516; A63B 23/03525; A63B 23/03533; A63B 23/03541; A63B 23/03558; A63B 23/03566; A63B 23/1218; A63B 71/0054; A63B 2071/0072; A63B 2071/0081; A63B 2225/09; A63B 2225/093; A63B 2225/10; A63B 2225/105; A63B 2225/107
See application file for complete search history.

(56) References Cited

U.S. PATENT DOCUMENTS

| | | | | |
|---|---|---|---|---|
| 6,527,683 | B2 | 3/2003 | Tolles | |
| 7,374,516 | B2 | 5/2008 | Lundquist | |
| 7,713,179 | B2 | 5/2010 | Webber | |
| 8,444,537 | B1 | 5/2013 | Santoro | |
| 9,302,139 | B2 | 4/2016 | Habing | |
| 10,245,461 | B2 | 4/2019 | Bruni et al. | |
| 10,556,144 | B2 | 2/2020 | Habing | |
| 10,646,740 | B2 | 5/2020 | Lee | |
| 11,389,690 | B2 | 7/2022 | Valdez et al. | |
| 11,565,144 | B2 | 1/2023 | Habing | |
| 11,712,593 | B2 * | 8/2023 | Kilby | A63B 21/0628 482/103 |
| 2002/0091043 | A1 | 7/2002 | Rexach | |
| 2009/0143203 | A1 | 6/2009 | Knapp | |
| 2009/0170668 | A1 | 7/2009 | Giannelli et al. | |
| 2010/0022363 | A1 | 1/2010 | Fenster et al. | |
| 2014/0087928 | A1 | 3/2014 | Luedeka | |
| 2016/0213967 | A1 | 7/2016 | Habing et al. | |
| 2017/0266480 | A1 | 9/2017 | Bruni et al. | |
| 2019/0217148 | A1 | 7/2019 | Bruni et al. | |
| 2019/0240525 | A1 * | 8/2019 | Leipheimer | A63B 21/0724 |
| 2019/0336812 | A1 * | 11/2019 | Leipheimer | A63B 23/03525 |
| 2020/0069988 | A1 | 3/2020 | Gore | |
| 2020/0316426 | A1 * | 10/2020 | Gore | A63B 21/154 |
| 2022/0096891 | A1 | 3/2022 | Yang | |
| 2022/0219033 | A1 | 7/2022 | Lee | |
| 2023/0001253 | A1 * | 1/2023 | Kilby | A63B 23/1209 |
| 2024/0157186 | A1 * | 5/2024 | Meredith | A63B 21/0628 |

OTHER PUBLICATIONS

GFS Smith Machine with Linear Bearings with 7° Angle Free-Weight Barbell , Home and Semi—Commercial Gym Workout Center Designed for Upper and Lower Body Exercise, G Fashion Style, Mar. 20, 2022, 8 pages, https://www.amazon.com/Machine-Linear-Bearings_Freeweight-Barbell/dp/B09W11KQ1G?ref_=ast_sto_dp.

United States International Searching Authority, International Search Report and Written Opinion for corresponding International Application No. PCT/US2023/084885, mailed May 17, 2024, 11 pages.

Alpha Smith Machine (0 or 7 Degree), Arsenal Strength Equipment, myarsenalstrength.com website, 2023, 5 pages.

* cited by examiner

DUAL ACTION WEIGHTLIFTING MACHINE WITH SELECTORIZED RESISTANCE

RELATED APPLICATION

The present application claims priority to U.S. Provisional Patent Application Ser. No. 63/395,112, filed Aug. 4, 2022, of same title, the full disclosure of which is incorporated herein by reference in its entirety for all purposes.

TECHNICAL FIELD

The present invention relates to exercise machines in general and to exercise machines of the type which have an exercise bar that is guided in two directions to simulate free-weight barbell exercise movements. The present application also relates to cable pull exercise machines.

SUMMARY OF THE INVENTION

The present system combines a guided-bar exercise machine, hereafter referred to as a "2D Smith Machine" together with a dual cable pull exercise machine, providing the advantages of both machines in a single exercise machine frame. One advantage of the present system is that it is selectorized (i.e.: it uses weight stacks as opposed to free weights) for both the 2D Smith Machine and for the two cable pull exercise assemblies. A particular advantage of the present system is that both the cable pull exercise machine and the 2D Smith exercise machine portions of the present device share the same weight stacks.

In optional embodiments, the present system is provided solely as a 2D Smith machine with the arm cable exercise portions removed. Different cabling systems for these embodiments are illustrated.

In one preferred aspect, the present pulley assemblies are configured such that the lifting bar lifts 100% of the selected weight in the weight stack(s) whereas the cable pulleys only lift 50% of the selected weight in the weight stack(s). In alternate embodiments, the lifting bar lifts 50% of the selected weight in the weight stack. It is to be understood, however, that other configurations and weight percentages are also encompassed within the scope of the present system. Specifically, different weight resistances can be provided to the lifting bar and to the cable pulleys based solely on the arrangement of the various pulleys within the present system.

2D Smith machines such as taught by Randall Webber in U.S. Pat. No. 7,713,179, have stationary racking positions for the lifting bar and adjustable "safety tiers" that insure that a lifting bar cannot accidently fall on a user by providing a bottom height below which the lifting bar is not able to fall. Accordingly, 2D Smith machines are popular both for doing squats and for doing bench presses. Typically, a 2D Smith machine provides a frame with guard rails or latches that prevent the lifting bar from falling below the pre-set bottom height. This has the benefit of providing a more natural lifting experience. As will be shown, the present exercise device offers all of these advantages. Specifically, with the present system, the user is able to move the lifting bar back and forth (horizontally) while also lifting the bar (vertically). This assists the user in developing balance while simultaneously developing their strength working different muscle groups.

In preferred aspects, the present system comprises an exercise machine, comprising: (a) a frame; (b) a pair of weight stacks connected to opposite sides of the frame; (c) a pair of vertically moveable pulley carriages connected to front portions of the frame; (d) a lifting bar assembly connected to a rear portion of the frame, wherein the lifting bar assembly comprises: (i) a lifting bar, (ii) a vertically moveable bar mount supporting each end of the lifting bar, and (iii) a vertically moveable locking mechanism for setting a bottom height for each of the vertically moveable bar mounts; (e) a pair of arm cables, wherein each of the arm cables are connected to one of the pulley carriages and pass around a first series of pulleys such that the weight stacks are lifted when a free end of the arm cables are pulled by a user through the pulley carriages; and (f) a pair of lifting bar cables, wherein a free end of each of the lifting bar cables are connected to one of the vertically moveable bar mounts and pass around a second series of pulleys such that the weight stacks are lifted when the lifting bar is raised by the user.

Preferably, the vertically moveable locking mechanism comprises: a vertically moveable lower stop on which the bar mount rests, a pull pin assembly connected to the lower stop, and a frame member having a series of vertical holes dimensioned to receive the pull pin therein. In operation, the user rotates the lifting bar to release a pull pin, thereby permitting adjustment of the vertical height of the lower stop (which sets the bottom height below which the lifting bar cannot fall). Preferably as well, the lifting bar can be moved in a horizontal direction on the frame during a vertical lift. This provides the benefit of a more natural workout (as opposed to a more traditional Smith machine which just permits straight up and down movement of the lifting bar in a constrained, typically vertical, plane).

Preferably, the vertically moveable pulley carriages are each mounted to a vertically extending carriage support that is independently rotatable about a vertical axis. The benefit of such rotation is that it permits the user to pull the arm cables from a wide variety of directions, thereby providing exercises to more of the user's muscles.

In preferred aspects, the arm cables and lifting bar cables can both be passed around a transfer pulley assembly which moves in a manner such that pulling on either of the arm cable or the lift bar cable results in the weight stack being lifted to a different height. This gearing-style use of the transfer pulley assembly has the advantage of using the same weight stack for two very different exercises (in which a user typically lifts two different amounts of weight). In one specific embodiment, the placement of the transfer pulley assembly results in the user lifting half the load when performing cable arm pulls as compared to when performing lifting bar raises. It is to be understood, however, that other geometries and percentages could instead be used, all keeping within the scope of the present invention.

In optional aspects where the arm cable exercise portion of the device is removed, the present system comprises an exercise machine, comprising: (a) a frame; (b) a pair of weight stacks connected to opposite sides of the frame; (c) a lifting bar assembly connected to a rear portion of the frame, the lifting bar assembly comprising: (i) a lifting bar, (ii) a vertically moveable bar mount supporting each end of the lifting bar, and (iii) a vertically moveable locking mechanism for setting a bottom height for each of the vertically moveable bar mounts; and (d) a pair of lifting bar cables, wherein each of the lifting bar cables are connected to one of the vertically moveable bar mounts and pass around a second series of pulleys such that the weight stacks are lifted when the lifting bar is raised by the user.

In further optional embodiments, a pull-up assembly can be mounted onto the front of the frame and may include a pair of flip-and-grip handles. As such, the user is able to do lifting bar exercises, cable arm pull exercises and pull-up exercises on the same exercise machine frame.

DETAILED DESCRIPTION OF THE DRAWINGS

Figure 5:
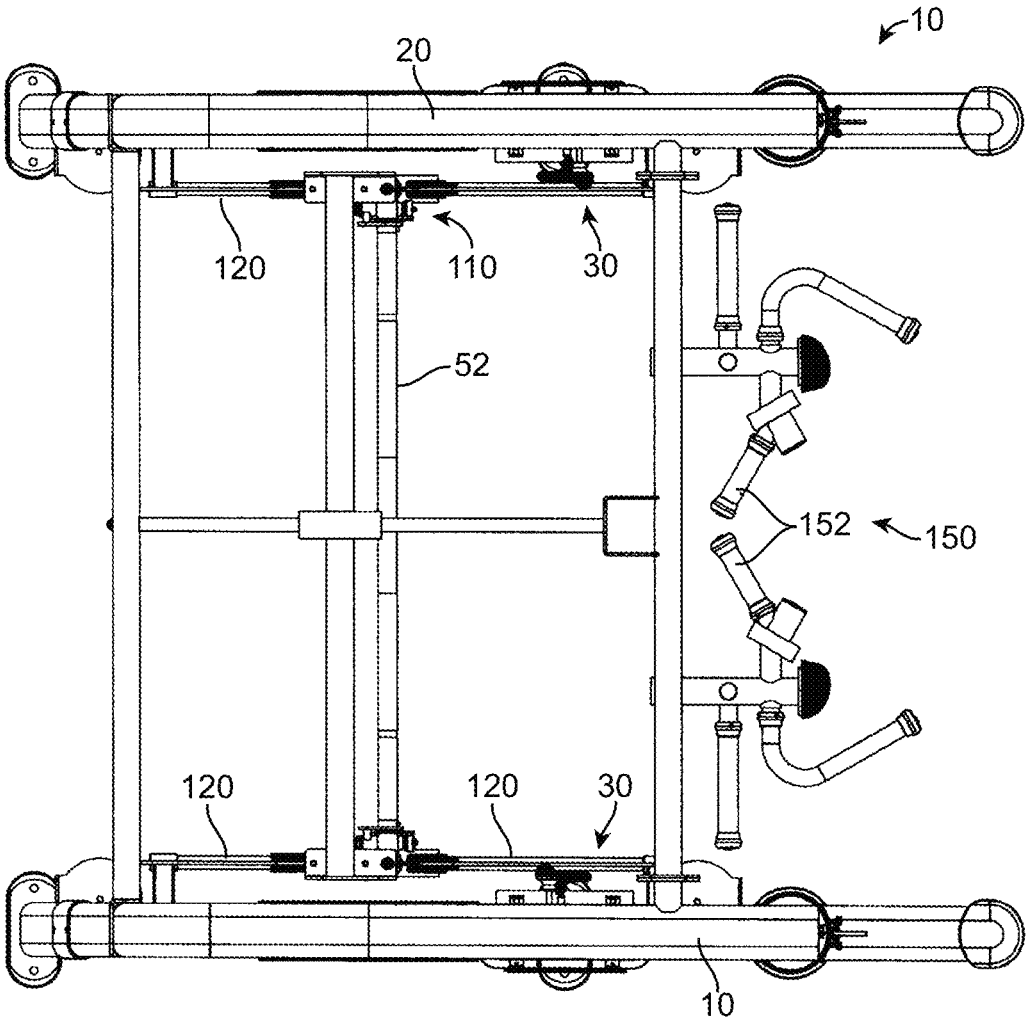
FIG. 5 is a top plan view of the exercise machine corresponding to FIG. 1.
Figure 6:
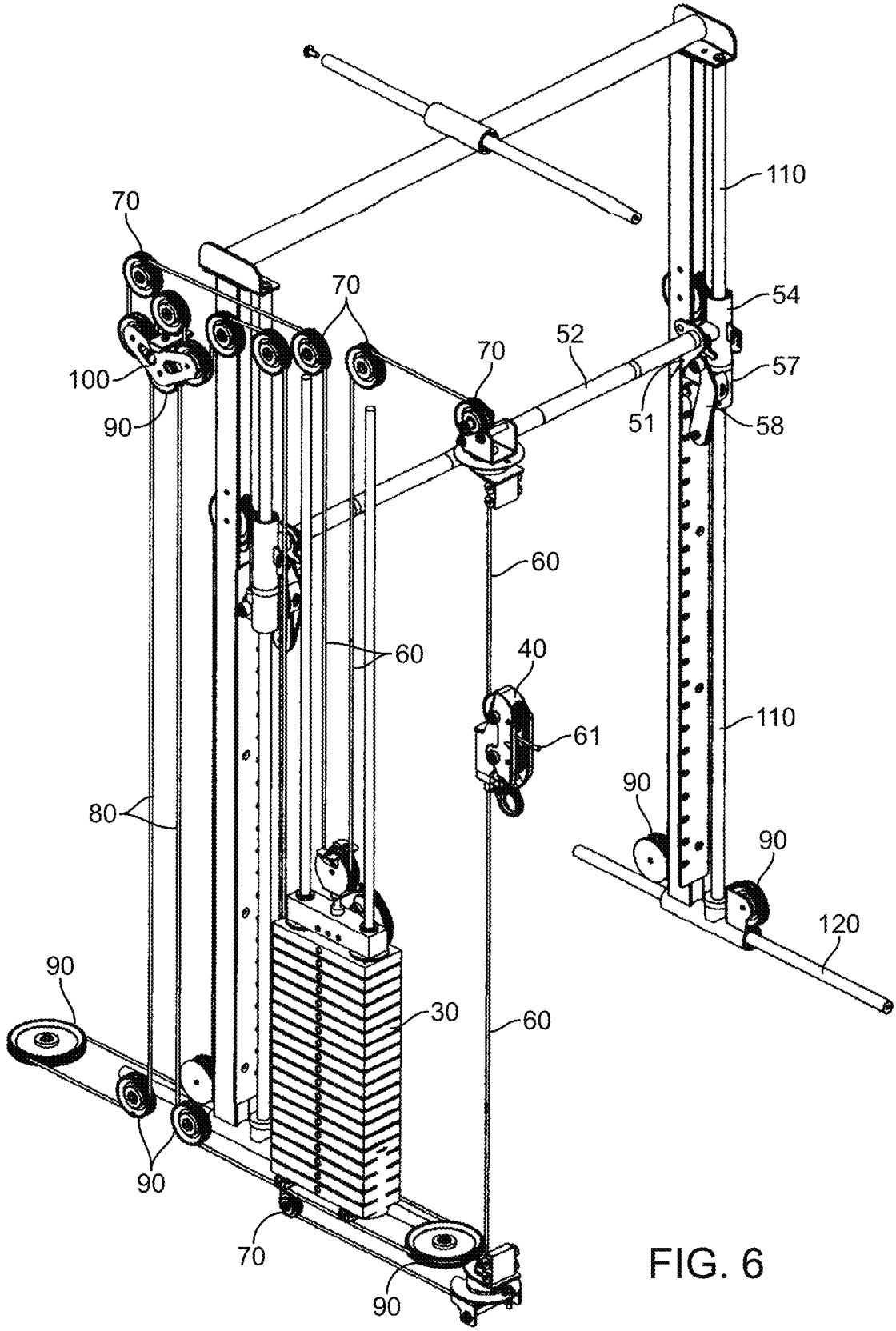
FIG. 6 is a front perspective view of the exercise machine of FIG. 1 with elements of the device removed to show operation and layout of the cables.
Figure 7:
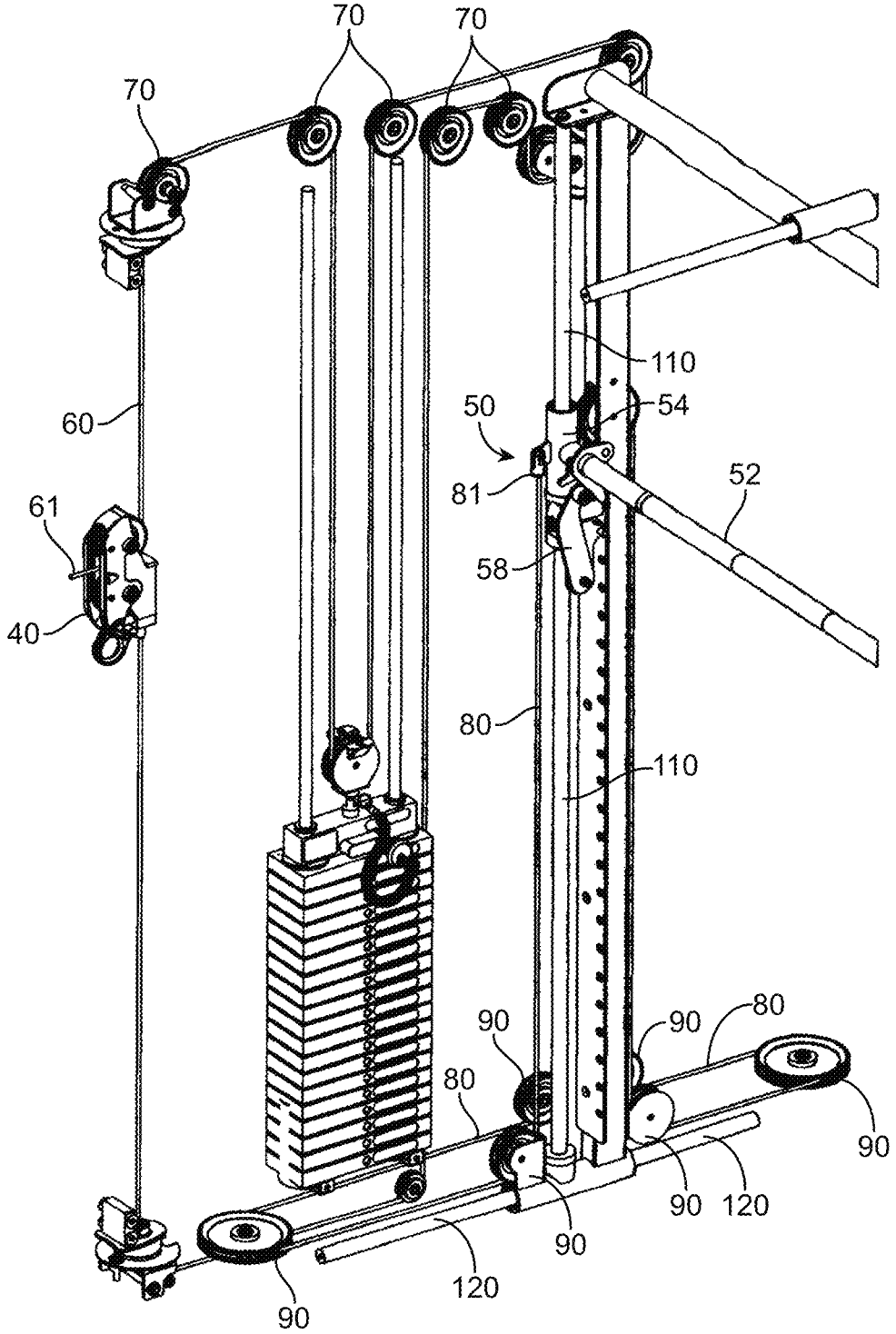
FIG. 7 is a front perspective view of the left side of the exercise machine corresponding to FIG. 6.
Figure 8:
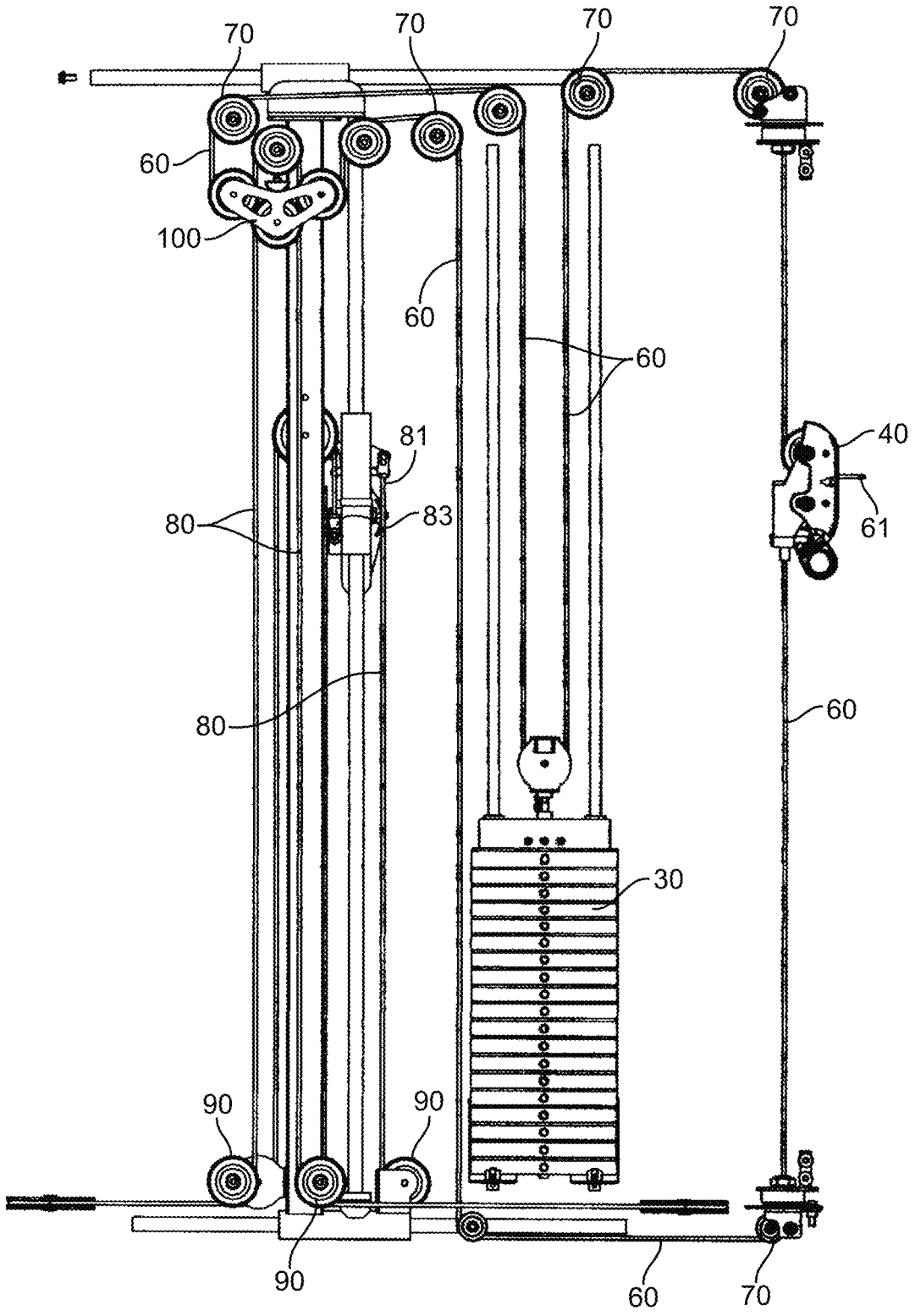
FIG. 8 is a side elevation view of the left side of the exercise machine corresponding to FIG. 6.
Figure 9:
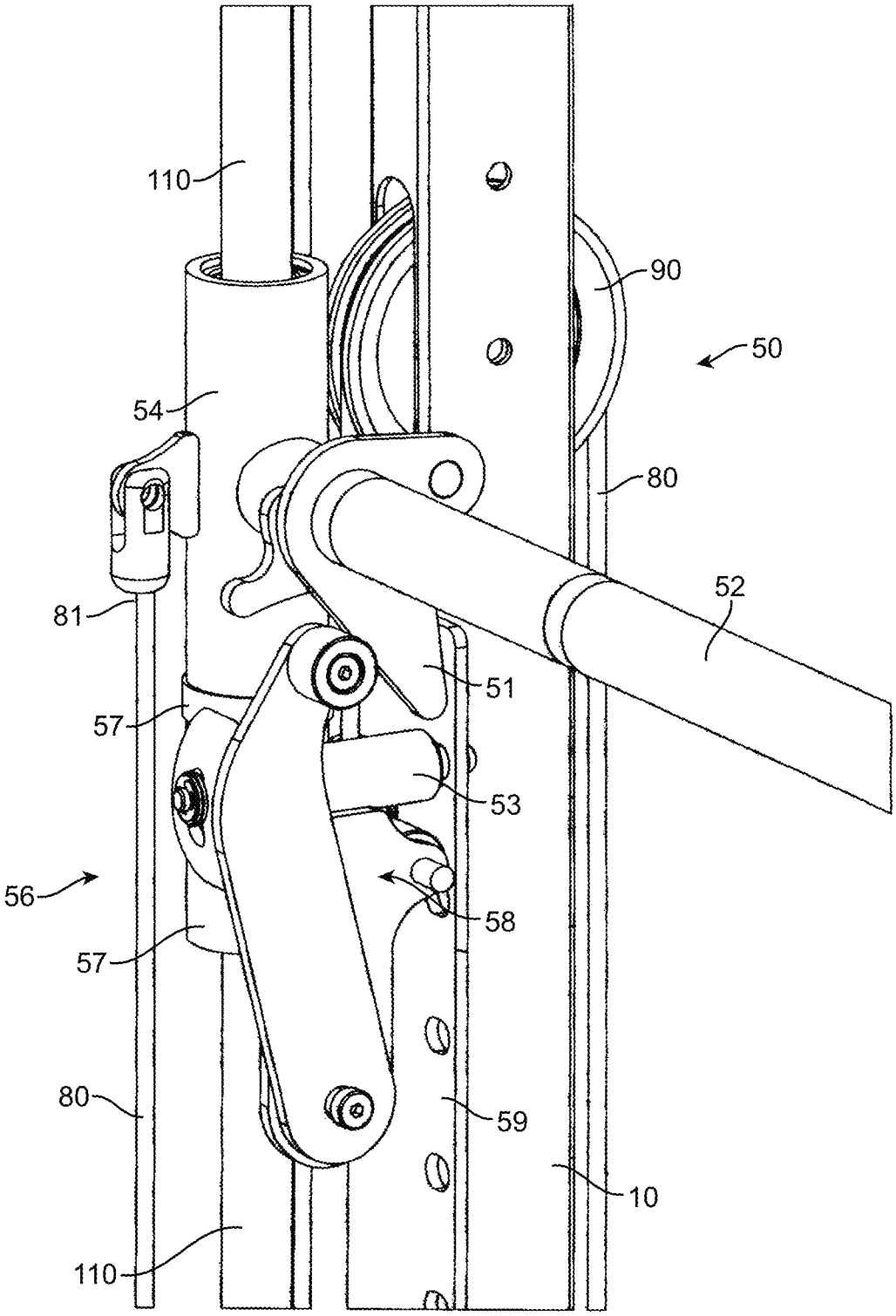
FIG. 9 is a close up perspective view of the locking mechanism for the lifting bar.
Figure 10:
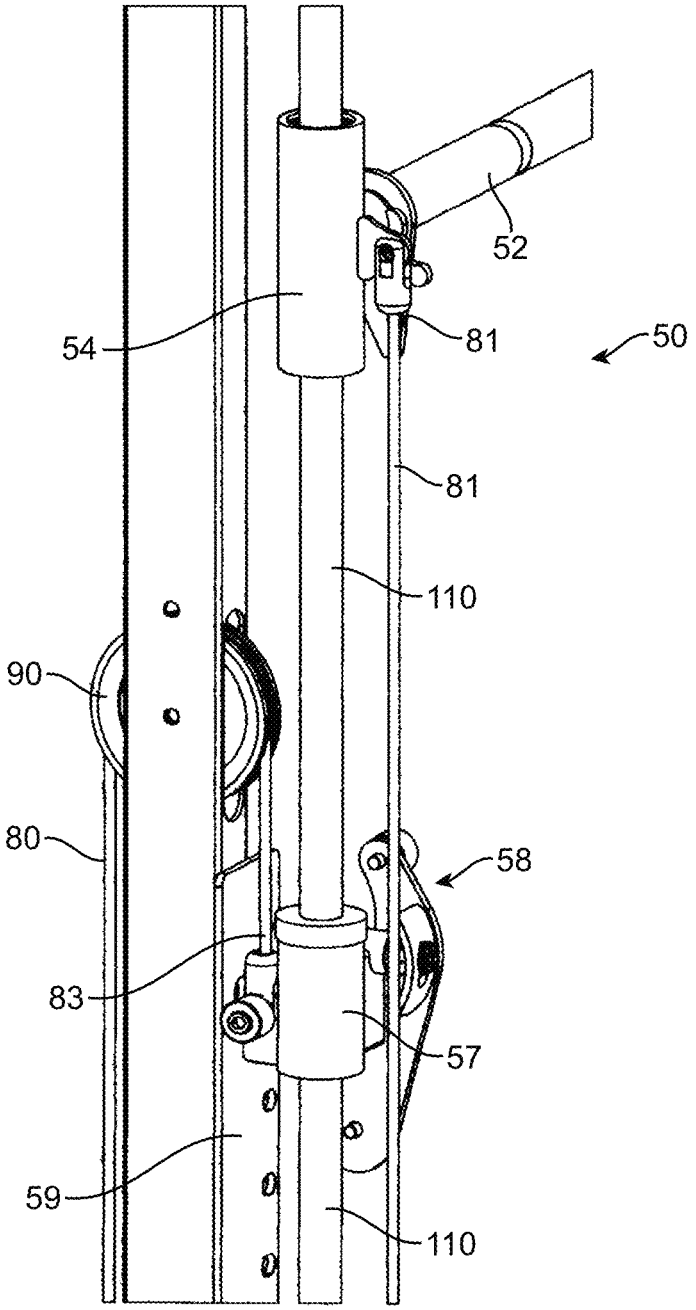
FIG. 10 is a view similar to FIG. 9, but taken from the other side of the device.
Figure 11:
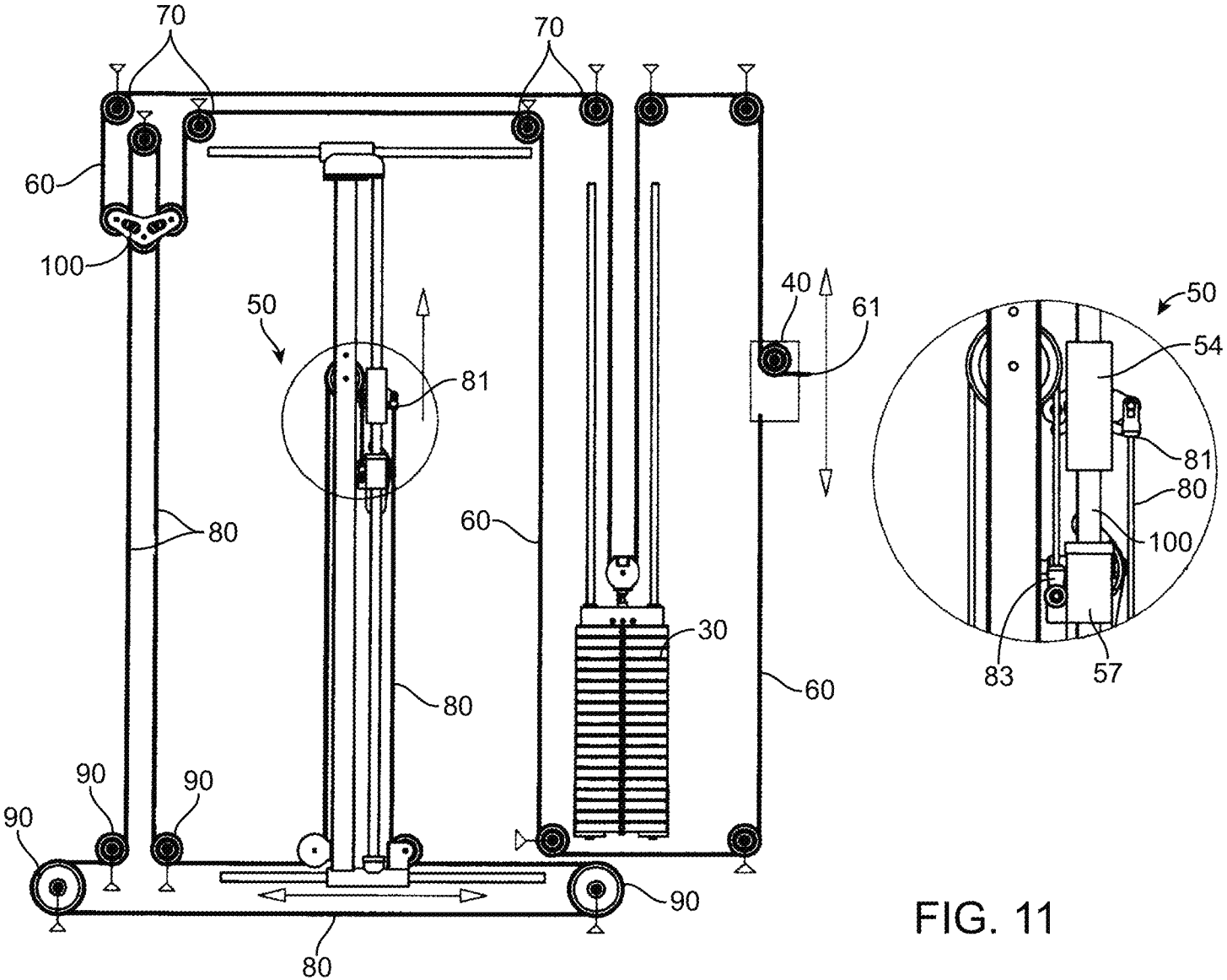
FIG. 11 is a simplified illustration of the cabling of the exercise machine of FIGS. 1 to 10.
Figure 18:
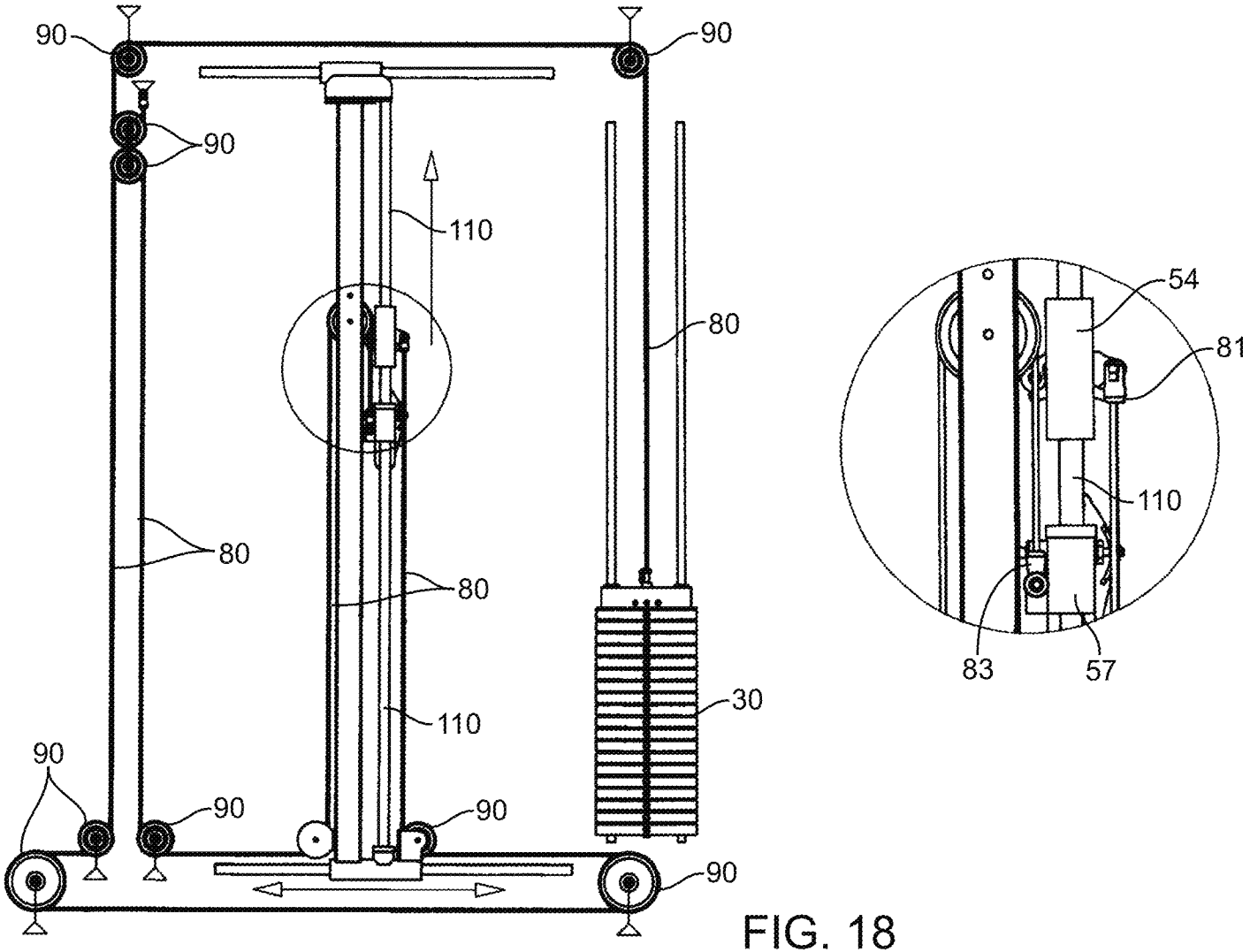
FIG. 18 is a simplified illustration of the cabling of the exercise machine of FIGS. 15 to 17.
Figure 19:
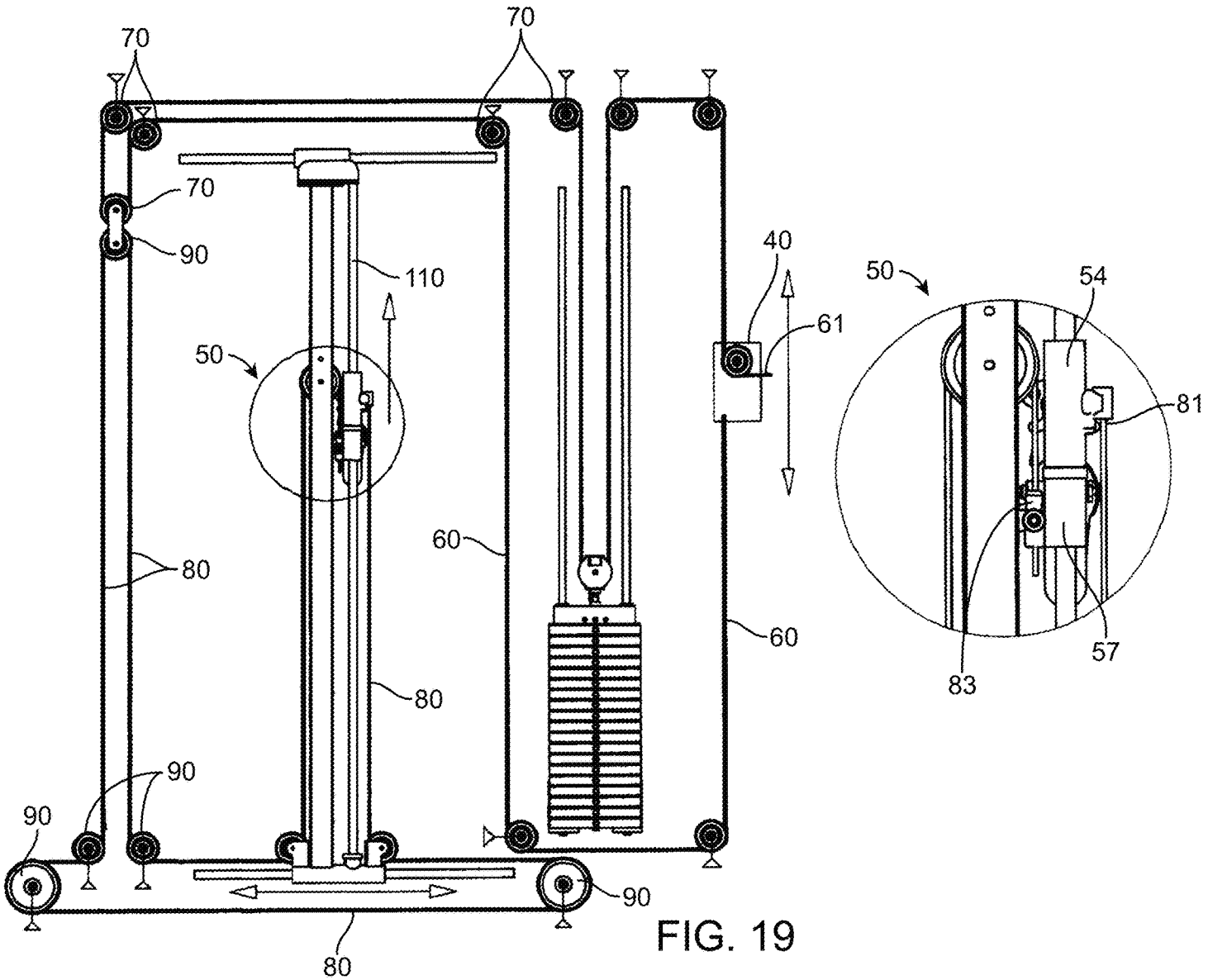
FIG. 19 is a simplified illustration of an alternate cabling system in which the lifting bar lifts 50% of the selected weight in the weight stack.

FIGS. 1 to 5 show various views of the present combined Smith-type exercise and arm pull exercise machine. FIGS. 6 to 8 show details of the preferred cabling systems (with various system components removed for clarity of illustration). FIGS. 9 and 10 illustrate a preferred embodiment of the locking mechanism used to pre-set the lowest vertical point of travel of the lifting bar. FIG. 11 explains the cabling layout in the exercise machine of FIGS. 1 to 10. FIGS. 12 to 17 illustrate optional preferred embodiments of the present system having only a Smith-style exercise machine with no arm pull exercise machine. FIG. 18 explains the cabling layout in the exercise machine when the arm pull portion of the machine has been omitted. Lastly, FIG. 19 shows an alternate cabling approach in which the lifting bar instead only lifts 50% of the selected weight in the weight stack.

Referring to the attached FIGS. 1 to 10, the present system provides a combined Smith-type exercise machine, cable arm pull exercise machine and pull-up exercise machine all within a single integrated frame, as follows.

Exercise machine 10 comprises a frame 20, a pair of weight stacks 30 on opposite sides of the frame 10, and a pair of vertically moveable pulley carriages 40 mounted to the front of frame 10 as shown. Also included is a lifting bar assembly 50 comprising a lifting bar 52, a vertically moveable bar mount 54 supporting each end of lifting bar 52, and a vertically moveable locking mechanism 56 for setting a bottom height of travel for each of the vertically moveable bar mounts 54. Also included are a pair of arm cables 60, wherein each of the arm cables are connected to one of the pulley carriages 40 and pass around a first series of pulleys 70 such that the weight stacks 30 are lifted when the free end of arm cables 40 are pulled by a user through the pulley carriages 40. In addition, a pair of lifting bar cables 80 are also provided. A free end of each of the lifting bar cables are connected to one of the vertically moveable bar mounts 54 and pass around a second series of pulleys 90 such that the weight stacks 30 are lifted when lifting bar 52 is raised by the user.

In preferred aspects, the vertically moveable locking mechanism 56 comprises: a vertically moveable lower stop 57 on which bar mount 54 rests, a pull pin assembly 58 connected to lower stop 57, and a frame member 59 having a series of vertical holes dimensioned to receive the pull pin therein. In operation, rotation of lifting bar 52 releases a pull pin 53 in the pull pin assembly 58, thereby permitting vertical adjustment of the height of the lower stop. This may be accomplished by a flange 51 on lifting bar 52 engaging with pull pin assembly 58 when the lifting bar 52 is rotated.

As can also be seen, one end 81 of the lifting bar cables 80 is connected to one of the bar mounts 54. Another free end 83 is connected to lower stop 57. As such, when the user raises lifting bar 52, the free end 81 of cable 80 is raised, and cable 80 is thereby tightened, in turn lowering transfer pulley assembly 100. This in turn has the effect of pulling on cable 60 which in turn raises weight stack 30. As can be seen, one of each of arm cables 60 and lifting bar cables 80 are disposed on either side of the frame. In the present system, no cables are required to pass from one side of the frame to the other. This has the beneficial effect of keeping the center space of frame 10 open for the user to perform exercises in.

Preferably, the vertically moveable pulley carriages 40 are each mounted to a vertically extending carriage support 42 that is rotatable about a vertical axis. This permits the user to pull on cables 60 from a wide variety of angles, thereby exercising different parts of the user's arms and back.

Figure 1:
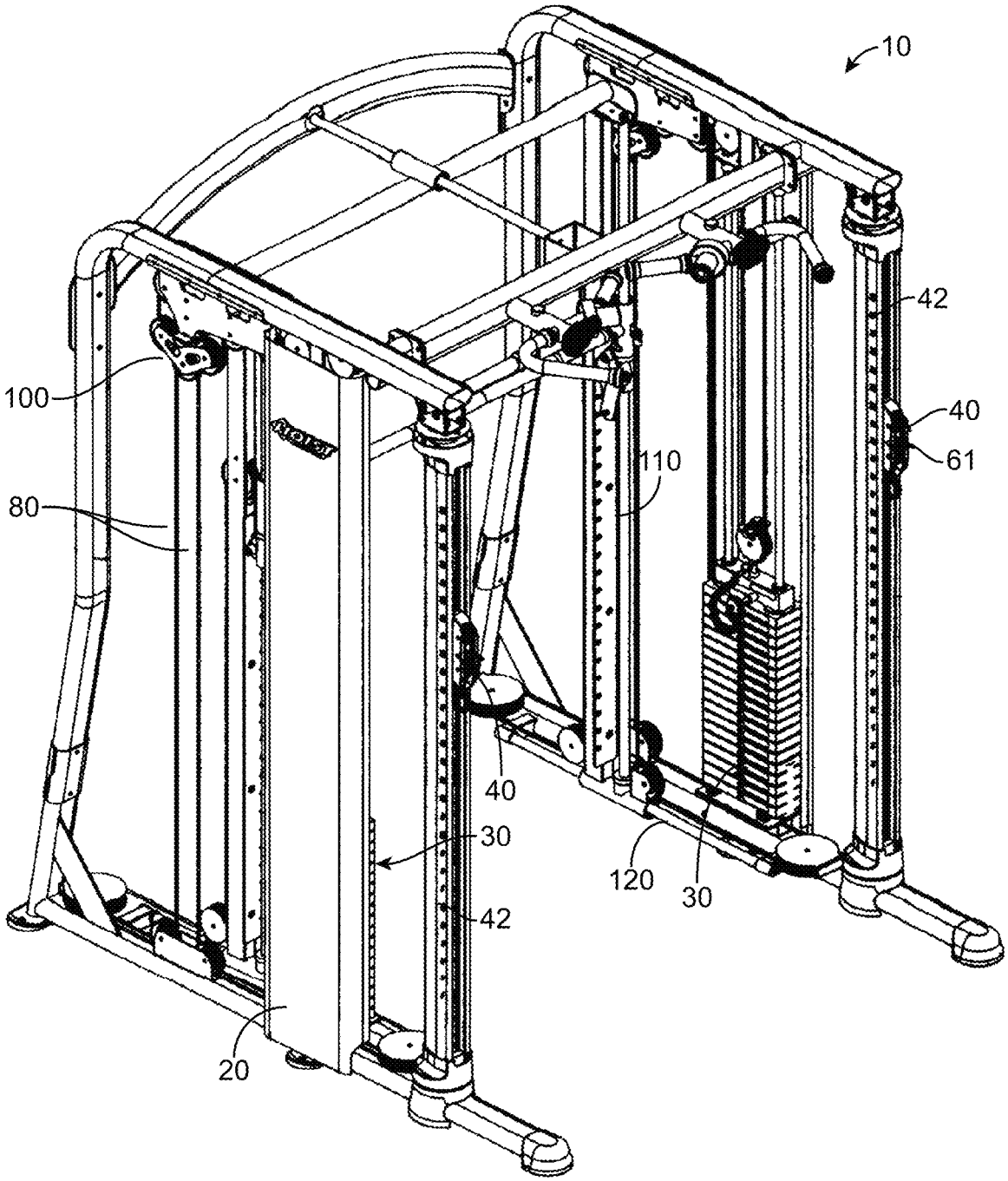
FIG. 1 is a front perspective view of the present 2D Smith-type exercise machine having forwardly facing dual cable columns exercise carriages.
Figure 2:
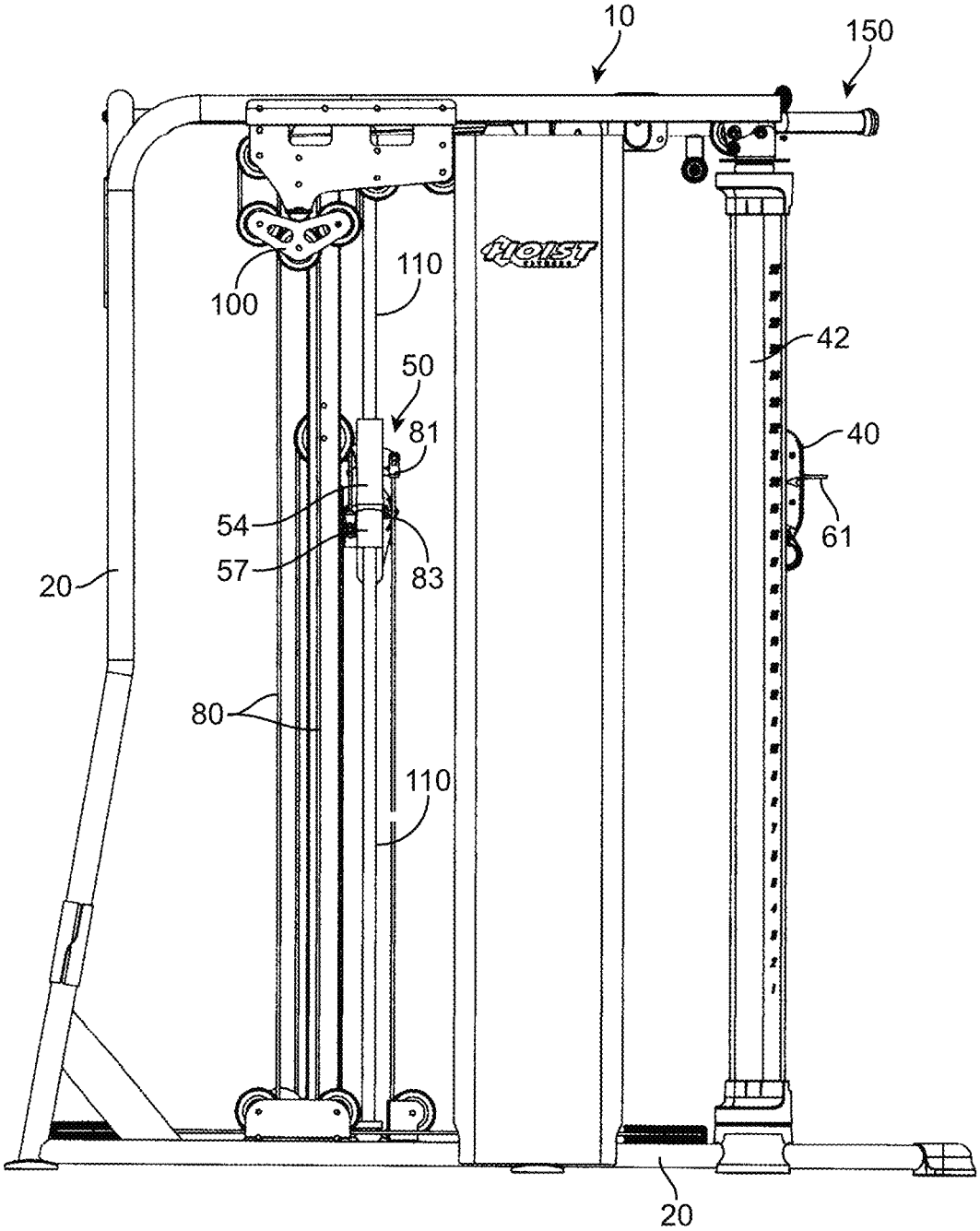
FIG. 2 is a side elevation view of the exercise machine corresponding to FIG. 1.
Figure 3:
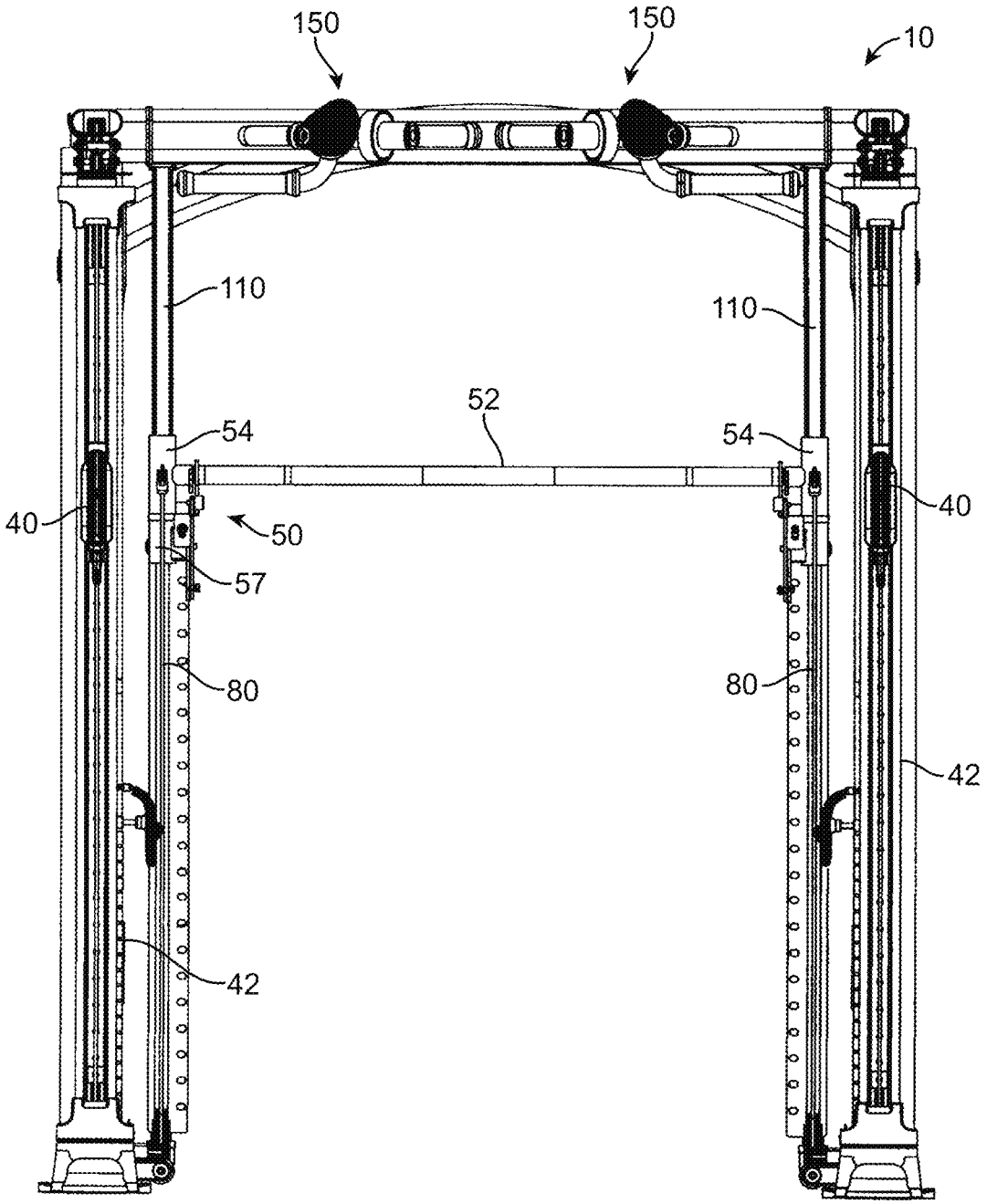
FIG. 3 is a front elevation view of the exercise machine corresponding to FIG. 1.
Figure 4:
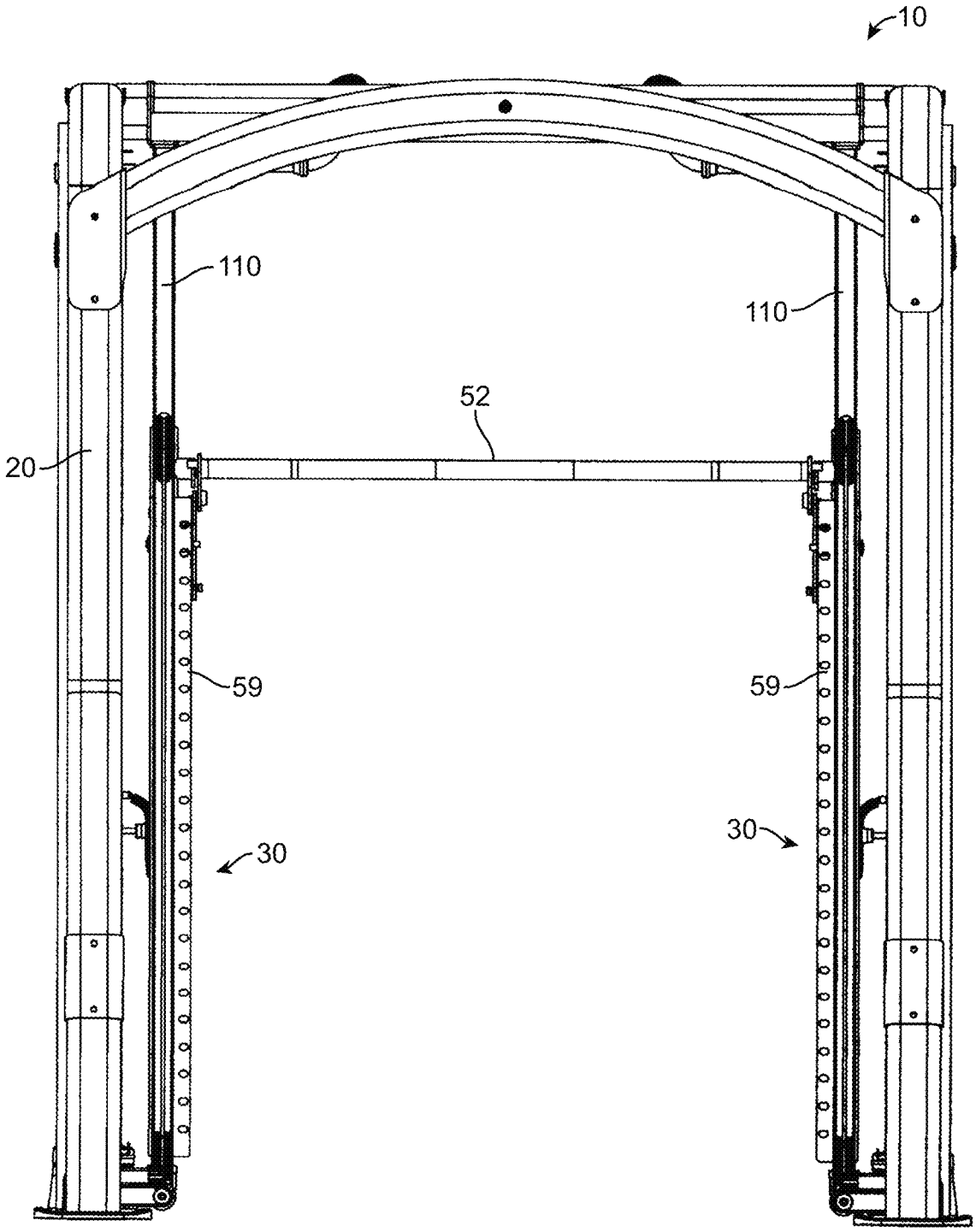
FIG. 4 is a rear elevation view of the exercise machine corresponding to FIG. 1.

In preferred aspects, the lifting bar 52 and lifting bar assemblies 50 are moveable in a horizontal direction on the frame. This is best seen in FIGS. 1, 5 and 9 where lifting bar 52 and lifting bar assemblies 50 are supported on a vertical member 110 which in turn is moveable back and forth in a horizontal direction along horizontal member 120.

One of each of the arm cables 60 and the lifting bar cables 80 pass around transfer pulley assemblies 100, as shown. In preferred aspects, the positioning of pulleys 70 and and transfer pulley assemblies 100 is configured such that the vertical height of transfer pulley assemblies 100 remains constant when the arm cable 60 is pulled to raise the weight stack 30, but the vertical height of the transfer pulley assemblies 100 changes when the lifting bar cable 80 is pulled to raise weight stack 30. As a result, pulling the arm cable 60 and the lifting bar cable 80 an equal distance results in weight stack 30 moving different distances. For example, pulling the arm cable 60 a distance of X inches lifts the weight stack a distance ½ X inches, whereas pulling the lifting arm cable 80 the same distance of X inches lifts the weight stack by distance X inches.

FIG. 11 is a simplified illustration of the cabling of the exercise machine of FIGS. 1 to 10.

In further preferred aspects, a pull-up assembly 150 is mounted to the front of frame 10. Pull-up assembly 150 may optionally comprise a pair of flip-and-grip handles 152.

Figure 12:
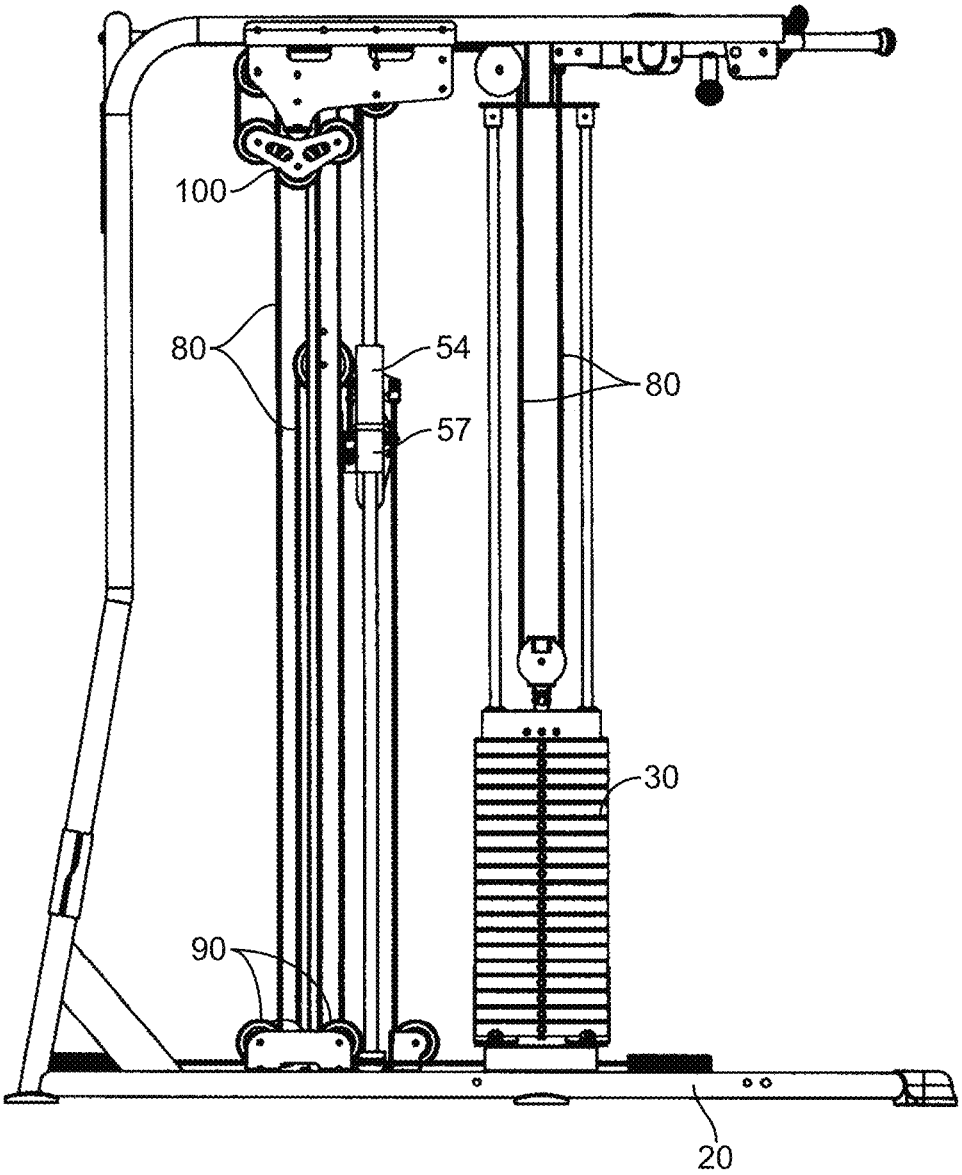
FIG. 12 is a side elevation view of a first embodiment of the present exercise machine where the arm cable exercise portion of the machine has been removed.
Figure 13:
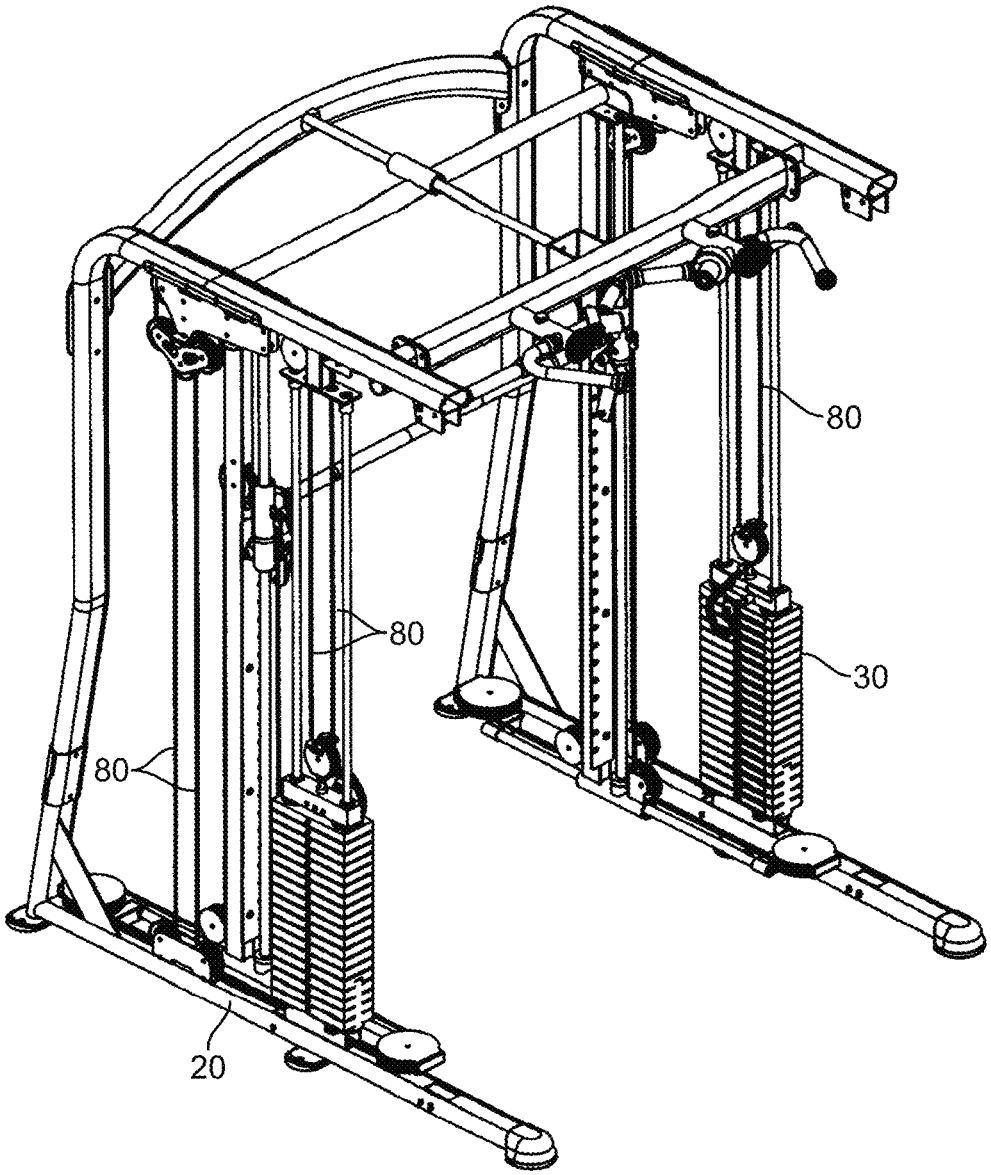
FIG. 13 is a front perspective view of the exercise machine of FIG. 12.
Figure 14:
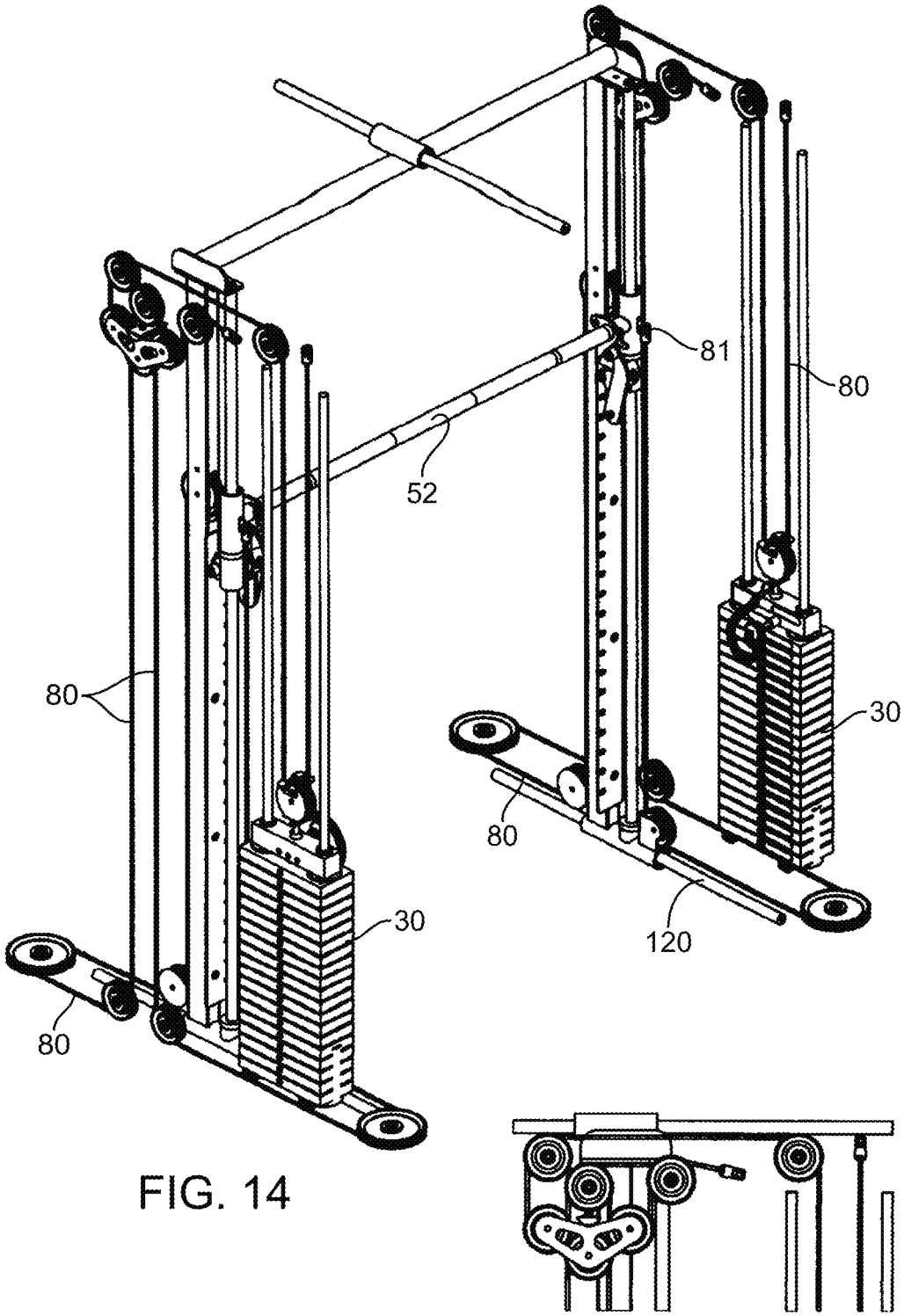
FIG. 14 is a front perspective view of the exercise machine of FIG. 12 with elements of the device removed to show operation and layout of the cables.
Figure 15:
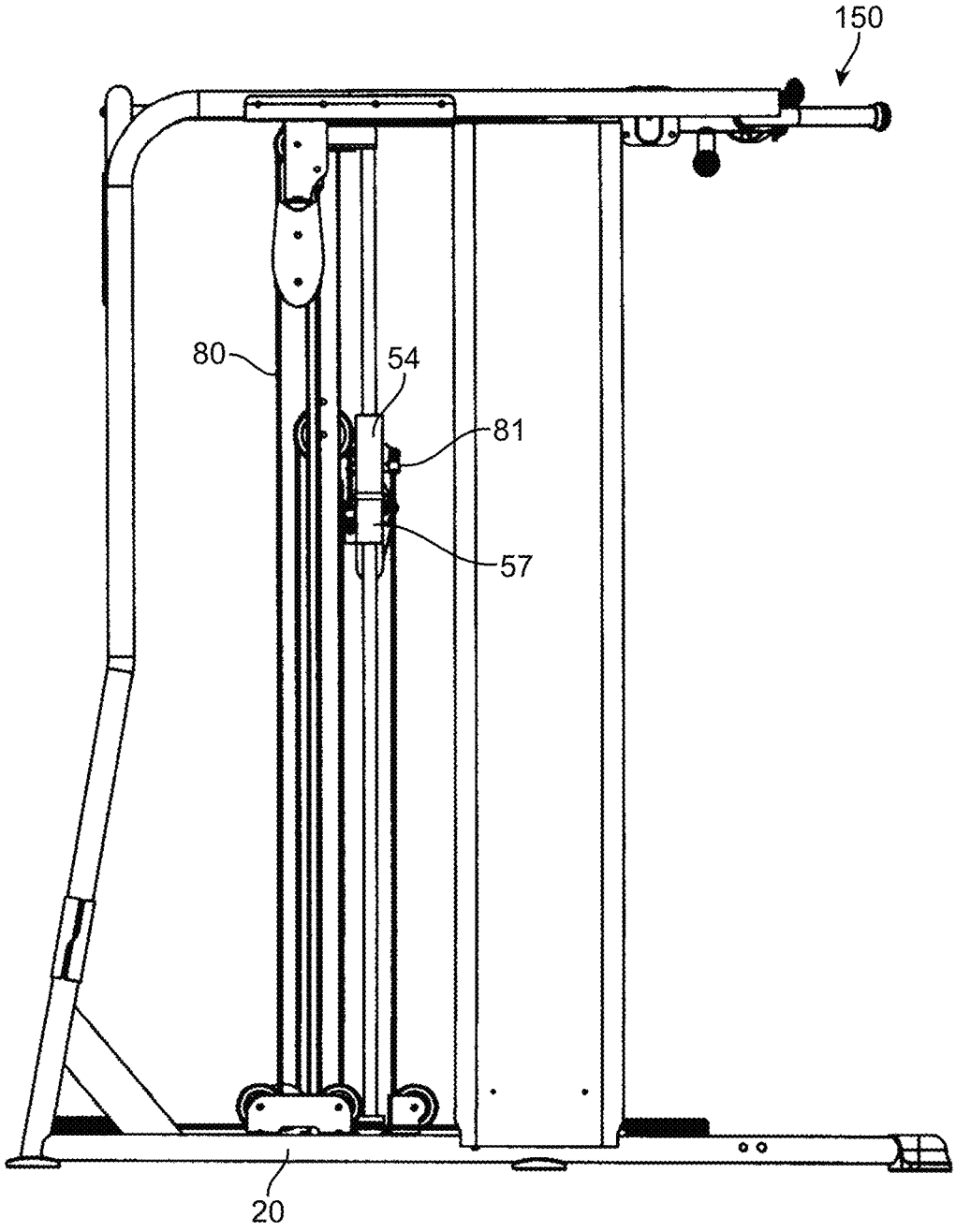
FIG. 15 is a side elevation view of a second embodiment of the present exercise machine where the arm cable exercise portion of the machine has been removed.
Figure 16:
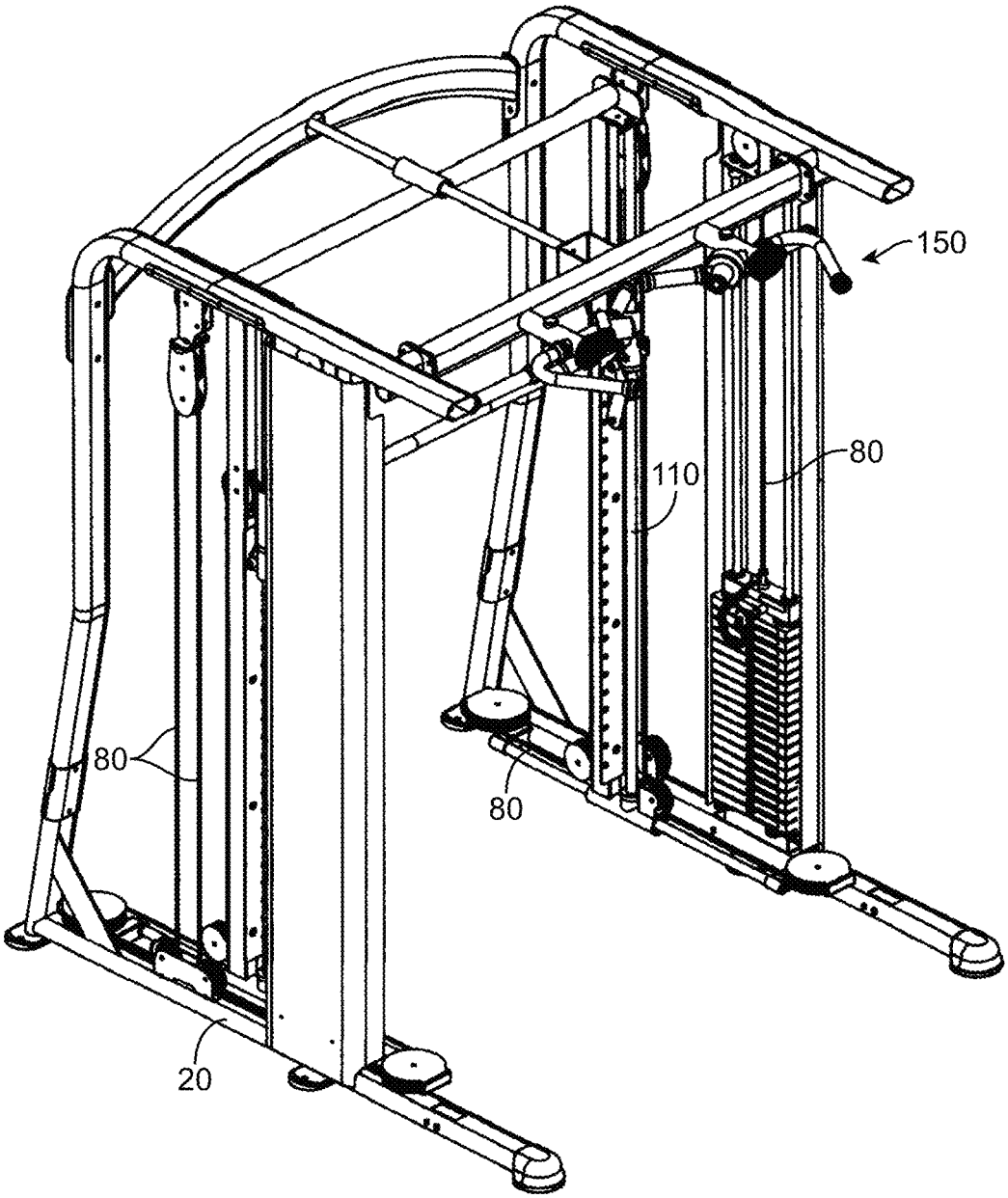
FIG. 16 is a front perspective view of the exercise machine of FIG. 15.
Figure 17:
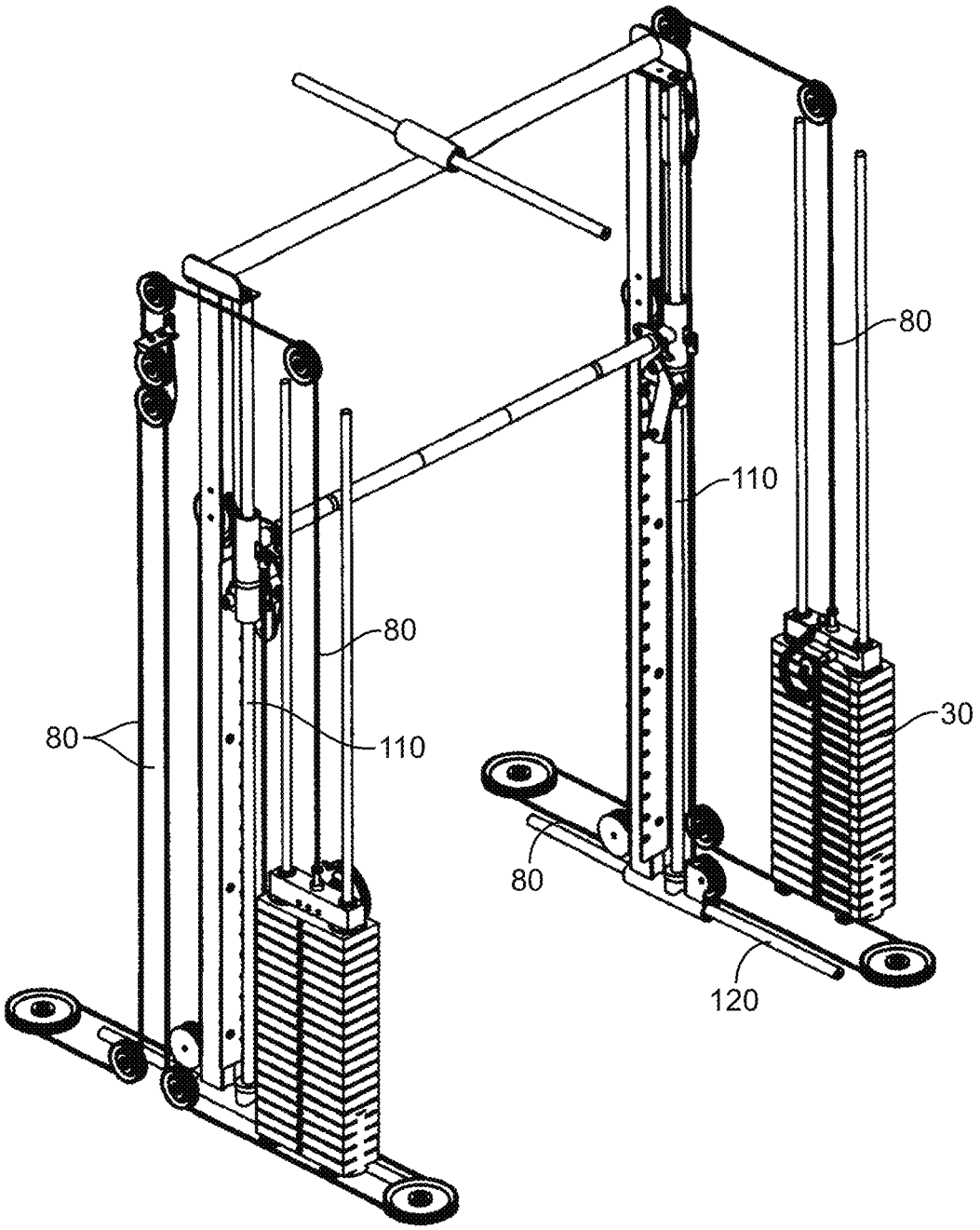
FIG. 17 is a front perspective view of the exercise machine of FIG. 15 with elements of the device removed to show operation and layout of the cables.

FIGS. 12 to 17 show embodiments of the present exercise machine, but with the optional cable arm exerciser portion removed. FIGS. 12 to 14 show a first embodiment having the option to add a cable arm exerciser thereto (by later replacing the cables shown with longer ones), and FIGS. 15 to 17 show a second embodiment in which a cable arm exerciser cannot be added thereto. FIGS. 15 to 17 illustrate the simplicity in cabling the 2D Smith-type portion of the exercise device in this particular embodiment. FIG. 18 is a simplified illustration of the cabling of the exercise machine of FIGS. 15 to 17.

Lastly, FIG. 19 is an alternate cabling system similar to FIG. 18, but in which the lifting bar instead lifts only 50% of the selected weight in the weight stack.

What is claimed is:

1. An exercise machine, comprising:

a frame;

a pair of weight stacks connected to opposite sides of the frame;

a pair of vertically moveable pulley carriages connected to front portions of the frame;

a lifting bar assembly connected to a rear portion of the frame, the lifting bar assembly comprising:

a lifting bar, a vertically moveable bar mount supporting each end of the lifting bar, and a vertically moveable locking mechanism for setting a bottom height for each of the vertically moveable bar mounts;

a pair of arm cables, wherein each of the pair of arm cables is connected to a respective one of the pair of vertically moveable pulley carriages and passes around a first series of pulleys such that the pair of weight stacks are respectively lifted when the pair of arm cables are pulled by a user through the pair of vertically moveable pulley carriages; and a pair of lifting bar cables, wherein each of the pair of lifting bar cables is connected to a respective one of the vertically moveable bar mounts and passes around a second series of pulleys such that the pair of weight stacks are respectively lifted when the lifting bar is raised by the user.

2. The exercise machine of claim 1, wherein the vertically moveable locking mechanism comprises:

a vertically moveable lower stop on which the corresponding vertically moveable bar mount rests, a pull pin assembly connected to the vertically moveable lower stop, and a frame member having a series of vertical holes dimensioned to receive a pull pin of the pull pin assembly therein.

3. The exercise machine of claim 2, wherein rotation of the lifting bar releases the pull pin in the pull pin assembly, thereby permitting adjustment of a vertical height of the vertically moveable lower stop.

4. The exercise machine of claim 3, further comprising a flange on the lifting bar that engages the pull pin assembly when the lifting bar is rotated.

5. The exercise machine of claim 2, wherein one end of each of the pair of lifting bar cables is respectively connected to one of the vertically moveable bar mounts.

6. The exercise machine of claim 1, wherein the pair of vertically moveable pulley carriages are mounted to a pair of vertically extending carriage supports that are rotatable about a vertical axis, respectively.

7. The exercise machine of claim 1, wherein the lifting bar assembly, including the lifting bar, is moveable in a horizontal direction on the frame.

8. The exercise machine of claim 1, wherein the pair of arm cables and the pair of lifting bar cables are respectively disposed on the opposite sides of the frame.

9. The exercise machine of claim 1, further comprising a pair of transfer pulley assemblies, wherein the pair of arm cables and the pair of lifting bar cables respectively pass around the pair of transfer pulley assemblies.

10. The exercise machine of claim 9, wherein a vertical height of the pair of transfer pulley assemblies remains constant when the pair of arm cables are pulled to raise the pair of weight stacks, respectively.

11. The exercise machine of claim 9, wherein a vertical height of the pair of transfer pulley assemblies changes when the pair of lifting bar cables are pulled to raise the pair of weight stacks, respectively.

12. The exercise machine of claim 1, wherein pulling one of the pair of arm cables and a corresponding one of the pair of lifting bar cables an equal distance results in the corresponding weight stack moving different distances.

13. The exercise machine of claim 12, wherein:

pulling the one of the pair of arm cables a distance X lifts the corresponding weight stack a distance ½ X, and pulling the corresponding one of the pair of lifting bar cables the distance X lifts the corresponding weight stack the distance X.

14. The exercise machine of claim 1, further comprising:

a pull-up assembly mounted to a front of the frame.

15. The exercise machine of claim 14, wherein the pull-up assembly comprises a pair of flip-and-grip handles.

16. The exercise machine of claim 1, wherein movement of the pair of arm cables through the pair of vertically moveable pulley carriages lifts the pair of weight stacks, respectively.

* * * * *